US008490721B2

(12) United States Patent
Naidoo et al.

(10) Patent No.: US 8,490,721 B2
(45) Date of Patent: Jul. 23, 2013

(54) POLYCRYSTALLINE DIAMOND

(75) Inventors: Kaveshini Naidoo, Springs (ZA); Thembinkosi Shabalala, Springs (ZA)

(73) Assignee: Element Six Abrasives S.A., Luxembourg (LU)

( * ) Notice: Subject to any disclaimer, the term of this patent is extended or adjusted under 35 U.S.C. 154(b) by 425 days.

(21) Appl. No.: 12/791,457

(22) Filed: Jun. 1, 2010

(65) Prior Publication Data

US 2010/0300764 A1 Dec. 2, 2010

Related U.S. Application Data

(60) Provisional application No. 61/183,208, filed on Jun. 2, 2009.

(51) Int. Cl.
*E21B 10/36* (2006.01)
*E21B 10/46* (2006.01)

(52) U.S. Cl.
CPC ..... *E21B 10/46* (2013.01); *E21B 10/36* (2013.01)
USPC ..... 175/434; 175/426; 175/420.2; 175/433

(58) Field of Classification Search
USPC ..... 175/426, 420.2, 433, 434; 51/309
See application file for complete search history.

(56) References Cited

U.S. PATENT DOCUMENTS

| | | | | |
|---|---|---|---|---|
| 4,525,178 | A | 6/1985 | Hall | |
| 5,127,923 | A | 7/1992 | Bunting et al. | |
| 5,468,268 | A | 11/1995 | Tank et al. | |
| 5,505,748 | A | 4/1996 | Tank et al. | |
| 6,248,447 | B1 | 6/2001 | Griffin et al. | |
| 6,517,902 | B2 | 2/2003 | Drake et al. | |
| 7,074,247 | B2 | 7/2006 | Tank et al. | |
| 7,475,948 | B2 | 1/2009 | Hall et al. | |
| 7,487,849 | B2 | 2/2009 | Radtke | |
| 7,635,035 | B1 | 12/2009 | Bertagnolli et al. | |
| 2005/0115744 | A1 | 6/2005 | Griffin et al. | |
| 2005/0133277 | A1 | 6/2005 | Dixon | |
| 2006/0162969 | A1* | 7/2006 | Belnap et al. | 175/433 |
| 2006/0166615 | A1 | 7/2006 | Tank et al. | |
| 2007/0056778 | A1 | 3/2007 | Webb et al. | |
| 2007/0186483 | A1 | 8/2007 | Tank et al. | |
| 2007/0187153 | A1 | 8/2007 | Bertagnolli | |
| 2007/0187155 | A1 | 8/2007 | Middlemiss | |
| 2008/0115421 | A1 | 5/2008 | Sani | |

(Continued)

FOREIGN PATENT DOCUMENTS

| | | | |
|---|---|---|---|
| EP | 0278703 | A2 | 2/1988 |
| EP | 0974566 | A1 | 1/2000 |

(Continued)

OTHER PUBLICATIONS

Underwood, "Quantitative Stereography," Addison-Wesley, Reading MA (1970), pp. 1-40.

(Continued)

*Primary Examiner* — Cathleen Hutchins
(74) *Attorney, Agent, or Firm* — Bryan Cave LLP

(57) ABSTRACT

A polycrystalline diamond (PCD) material 10 comprising at least 88 volume percent and at most 99 volume percent diamond grains 12, the mean diamond grain contiguity being greater than 60.5 percent. The PCD material 10 is particularly but not exclusively for use in boring into the earth.

21 Claims, 5 Drawing Sheets

U.S. PATENT DOCUMENTS

| | | | | |
|---|---|---|---|---|
| 2008/0142276 | A1 | 6/2008 | Griffo et al. | |
| 2008/0185189 | A1 | 8/2008 | Griffo et al. | |
| 2008/0223621 | A1 | 9/2008 | Middlemiss et al. | |
| 2008/0223623 | A1 | 9/2008 | Keshavan et al. | |
| 2008/0230280 | A1 | 9/2008 | Keshavan et al. | |
| 2009/0071727 | A1 * | 3/2009 | Keshavan et al. | 175/434 |
| 2009/0090563 | A1 | 4/2009 | Voronin et al. | |
| 2009/0152018 | A1 | 6/2009 | Sani | |
| 2009/0173015 | A1 | 7/2009 | Keshavan et al. | |
| 2009/0173547 | A1 | 7/2009 | Voronin et al. | |
| 2009/0178855 | A1 | 7/2009 | Zhang et al. | |
| 2009/0183925 | A1 | 7/2009 | Zhang et al. | |
| 2009/0324873 | A1 | 12/2009 | Weis et al. | |
| 2010/0012389 | A1 | 1/2010 | Zhang et al. | |
| 2010/0084196 | A1 | 4/2010 | Bertagnolli et al. | |

FOREIGN PATENT DOCUMENTS

| | | | |
|---|---|---|---|
| JP | 03054166 | | 3/1991 |
| WO | 2004054943 | A1 | 7/2004 |
| WO | 2006032984 | A2 | 3/2006 |
| WO | 2007035394 | A2 | 3/2007 |
| WO | 2007110770 | A2 | 10/2007 |
| WO | 2009027948 | A1 | 3/2009 |
| WO | 2009027949 | A1 | 3/2009 |
| WO | 2009147629 | A1 | 12/2009 |

OTHER PUBLICATIONS

German, R.M., "The Contiguity of Liquid Phase Sintered Microstructures," Metallurgical Transactions A, vol. 16A, Jul. 1985, pp. 1247-1252.

Akaishi et al., "Thermal Properties of Sintered Diamond with Small Amounts of Metal," Science and Technology of New Diamond, (1990) pp. 129-134.

Akaishi et al., Material Science and Engineering A (1988), vol. 05/106, 1 and 2 (Abstract only).

* cited by examiner

POLYCRYSTALLINE DIAMOND

CROSS REFERENCE TO RELATED APPLICATIONS

This application claims the benefit of U.S. Provisional Application Ser. No. 61/183,208, filed on Jun. 2, 2009, which is hereby incorporated by reference in its entirety, including any figures, tables, and drawings.

FIELD OF THE INVENTION

Embodiments of the invention relate to polycrystalline diamond (PCD) material, a method for making same and tools comprising same, particularly but not exclusively for use in boring into the earth.

BACKGROUND OF THE INVENTION

Polycrystalline diamond (PCD) material comprises a mass of inter-grown diamond grains and interstices between the diamond grains. PCD may be made by subjecting an aggregated mass of diamond grains to a high pressure and temperature in the presence of a sintering aid such as cobalt, which may promote the inter-growth of diamond grains. The sintering aid may also be referred to as a catalyst material for diamond. Interstices within the sintered PCD material may be wholly or partially filled with residual catalyst material. PCD may be formed on a cobalt-cemented tungsten carbide substrate, which may provide a source of cobalt catalyst material for the PCD.

PCD material may be used in a wide variety of tools for cutting, machining, drilling or degrading hard or abrasive materials such as rock, metal, ceramics, composites and wood-containing materials. For example, tool inserts comprising PCD material are widely used within drill bits used for boring into the earth in the oil and gas drilling industry. In many of these applications, the temperature of the PCD material may become elevated as it engages rock or other workpiece or body with high energy. Unfortunately, mechanical properties of PCD material such as abrasion resistance, hardness and strength tend to deteriorate at elevated temperatures, which may be promoted by the residual catalyst material within it.

Akaishi et al. disclose in the Material Science and Engineering A (1988), volume 05/106, numbers 1 and 2, pages 517 to 523, a well-sintered diamond with a fine-grained homogeneous microstructure, which was synthesised at 7.7 GPa and 2,000 degrees centigrade when diamond powder with 1 to 5 volume percent Co or Ni additive was used as the starting material.

European patent publication number EP 1 931 594 discloses a method for producing a polycrystalline diamond (PCD) body with an arithmetic mean as-sintered grain size less than 1 micron, wherein the catalyst metal comprises an iron group metal such as cobalt and the sintering pressure is between about 2.0 GPa and 7.0 GPa.

United States patent application publication number 2005/0133277 discloses PCD made using a sintering pressure and temperature at 65 kbar and 1,400 degrees centigrade.

There is a need for polycrystalline diamond material having enhanced abrasion resistance.

SUMMARY OF THE INVENTION

An embodiment of the invention provides a polycrystalline diamond (PCD) material comprising a body comprising diamond grains having a mean diamond grain contiguity of greater than about 60 percent, greater than 60.5 percent, at least about 61.5 percent or even at least about 65 percent. In some embodiments of the invention, the diamond grains have a mean diamond grain contiguity of at most about 80 percent or at most about 77 percent. In one embodiment of the invention, the mean diamond grain contiguity may be in the range from 60.5 percent to about 77 percent, and in one embodiment, the mean diamond grain contiguity may be in the range from 61.5 percent to about 77 percent.

Embodiments of PCD material according to the invention may be made by a method including forming a plurality of diamond grains into an aggregated mass and subjecting the aggregated mass of diamond grains to a pressure treatment at a pressure of greater than 6.0 GPa, at least about 6.2 GPa or at least about 6.5 GPa in the presence of a metallic catalyst material for diamond at a temperature sufficiently high for the catalyst material to melt, and sintering the diamond grains to form PCD material; the diamond grains of the aggregated mass having the size distribution characteristic that at least 50 percent of the grains have an average size of greater than about 5 microns. In some embodiments, at least about 15 percent or 20 percent of the grains have an average size in the range from about 10 to about 15 microns. In some embodiments of the invention, the pressure is at most about 8 GPa, lower than 7.7 GPa, at most about 7.5 GPa, at most about 7.2 GPa or at most about 7.0 GPa. This method is an aspect of the invention.

An embodiment of the invention provides a PCD structure for cutting, boring into or degrading a body, at least a part of the PCD structure comprising a volume of an embodiment of PCD material according to an aspect of the invention. In some embodiments, at least part of the volume of the PCD material may have a thickness in the range from about 3.5 mm to about 12.5 mm or in the range from about 4 mm to about 7 mm.

An embodiment of the invention provides a tool or tool component for cutting, boring into or degrading a body, comprising an embodiment of a PCD structure according to an aspect of the invention. In some embodiments, the tool or tool component may be for cutting, milling, grinding, drilling, earth boring, rock drilling or other abrasive applications, such as the cutting and machining of metal. In one embodiment, the tool component may be an insert for a drill bit, such as a rotary shear-cutting bit, for boring into the earth, for use in the oil and gas drilling industry. In one embodiment, the tool may be a rotary drill bit for boring into the earth.

BRIEF DESCRIPTION OF THE DRAWINGS

Non-limiting embodiments will now be described with reference to the drawings of which.

The same reference numbers refer to the same features in all drawings.

DETAILED DESCRIPTION OF EMBODIMENTS

Figure 1:
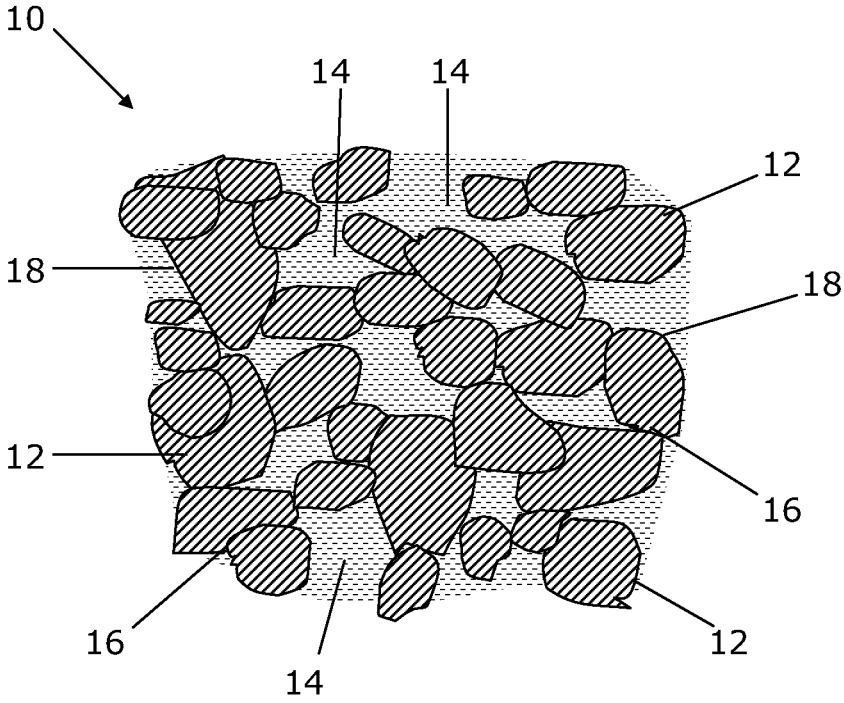
FIG. 1 shows a schematic drawing of the microstructure of an embodiment of PCD material.

As used herein, "polycrystalline diamond" (PCD) material comprises a body comprising a mass of diamond grains, a substantial portion of which are directly inter-bonded with each other and in which the content of diamond is at least about 80 volume percent of the material. In one embodiment of PCD material, interstices between the diamond grains may be at least partly filled with a binder material comprising a catalyst for diamond. As used herein, "interstices" or "interstitial regions" are regions between the diamond grains of PCD material. In embodiments of PCD material, interstices or interstitial regions may be substantially or partially filled with a material other than diamond, or they may be substantially empty. Embodiments of PCD material may comprise at least a region from which catalyst material has been removed from the interstices, leaving interstitial voids between the diamond grains.

In the field of quantitative stereography, particularly as applied to cemented carbide material, "contiguity" is understood to be a quantitative measure of inter-phase contact. It is defined as the internal surface area of a phase shared with grains of the same phase in a substantially two-phase microstructure (Underwood, E. E, "*Quantitative Stereography*", Addison-Wesley, Reading Mass. 1970; German, R. M. "*The Contiguity of Liquid Phase Sintered Microstructures*", Metallurgical Transactions A, Vol. 16A, July 1985, pp. 1247-1252). As used herein, "diamond grain contiguity" is a measure of diamond-to-diamond contact or bonding, or a combination of contact and bonding within PCD material.

As used herein, a "metallic" material is understood to comprise a metal in unalloyed or alloyed form and which has characteristic properties of a metal, such as high electrical conductivity.

As used herein, "catalyst material" for diamond, which may also be referred to as solvent/catalyst material for diamond, means a material that is capable of promoting the growth of diamond or the direct diamond-to-diamond intergrowth between diamond grains at a pressure and temperature condition at which diamond is thermodynamically stable.

A filler material is understood to mean a material that wholly or partially fills pores, interstices or interstitial regions within a polycrystalline structure.

The size of grains may be expressed in terms of equivalent circle diameter (ECD). As used herein, the "equivalent circle diameter" (ECD) of a particle is the diameter of a circle having the same area as a cross section through the particle. The ECD size distribution and mean size of a plurality of particles may be measured for individual, unbonded particles or for particles bonded together within a body, by means of image analysis of a cross-section through or a surface of the body.

As used herein, the words "average" and "mean" have the same meaning and are interchangeable.

In some embodiments of the invention, the standard deviation of the diamond grain contiguity may be at most about 4 percent contiguity, at most about 3 percent contiguity or at most about 2 percent contiguity.

In some embodiments of the invention, the volume of the PCD material may be at least about 0.5 $mm^2$, at least about 75 $mm^2$, at least about 150 $mm^2$ or at least about 300 $mm^2$.

In one embodiment of the invention, the diamond grains may have the size distribution characteristic that at least about 50 percent of the grains have an average size of greater than about 5 microns. In some embodiments, at least about 15 percent or at least about 20 percent of the grains have an average size in the range from about 10 microns to about 15 microns.

In one embodiment of the invention, the PCD material may comprise diamond grains having a multi-modal size distribution.

In some embodiments of the invention, the diamond grains may have an average size of greater than 0.5 microns or greater than 1 micron, and at most about 60 microns, at most about 30 microns, at most about 20 microns, at most about 15 microns or at most about 7 microns. In some embodiments of the invention, the PCD material may comprise diamond grains having a mean size of at most about 15 microns, less than about 10 microns or at most about 8 microns. In some embodiments of the invention, the diamond grains may have an average size in the range from about 0.5 microns to about 20 microns, in the range from about 0.5 microns to about 10 microns, or in the range from about 1 micron to about 7 microns.

In some embodiments of the invention, the content of the diamond in the PCD material may be at least about 88 volume percent, at least about 90 volume percent or at least about 91 volume percent of the PCD material. In one embodiment, the content of the diamond may be at most about 99 volume percent of the PCD material. In some embodiments of the invention, the diamond content of the PCD material may be in the range from about 88 volume percent to about 99 volume percent, or in the range from about 90 volume percent to about 96 volume percent of the PCD material.

In one embodiment, the PCD material may comprise catalyst material for diamond, and in one embodiment, the content of the catalyst material for diamond may be at most about 9 volume percent of the PCD material. In one embodiment, the content of the catalyst material for diamond may be at least about 1 volume percent of the PCD material. In some embodiments of the invention, the PCD material may comprise catalyst material for diamond in the range from about 1 volume percent to about 10 volume percent, in the range from about 1 volume percent to about 8 volume percent, or in the range from about 1 to about 4 volume percent of the PCD material.

In some embodiments of the invention, the PCD may have an average interstitial mean free path of at most about 1.5 microns, at most about 1.3 microns or at most about 1 micron. In some embodiments of the invention, the PCD may have an average interstitial mean free path of at least about 0.05 microns, at least about 0.1 micron, at least about 0.2 microns or at least about 0.5 microns. In some embodiments, the PCD may have an average interstitial mean free path in the range from 0.05 micron to about 1.3 micron, in the range from about 0.1 micron to about 1 micron or in the range from about 0.5 micron to about 1 micron.

In some embodiments of the invention, the standard deviation of the mean free path may be in the range from about 0.05 microns to about 1.5 micron, or in the range from about 0.2 micron to about 1 micron.

In some embodiments of the invention, the PCD material may have a mean interstitial size of at least about 0.5 micron, at least about 1 micron or at least about 1.5 microns. In some embodiments of the invention, the PCD material may have a mean interstitial size of at most about 3 microns or at most about 4 microns. In some embodiments, the standard deviation of the size distribution may be at most about 3 microns, at most about 2 microns or even at most about 1 micron.

In one embodiment of the invention, the PCD material may include a filler material comprising a ternary carbide of the formula MxM'yCz, M being at least one element selected from the group consisting of the transition metals and the rare earth metals; M' being an element selected from the group consisting of Al, Ga, In, Ge, Sn, Pb, Tl, Mg, Zn and Cd; x being in the range from 2.5 to 5.0; y being in the range from 0.5 to 3.0; and z being in the range from 0.1 to 1.2; and the PCD comprising diamond grains having average size in the range from 0.5 microns to 10 microns. In some embodiments, M may be selected from the group consisting of Co, Fe, Ni, Mn, Cr, Pd, Pt, V, Nb, Ta, Ti, Zr, Ce, Y, La and Sc. In one embodiment, x may be 3. In one embodiment, y may be 1.

In some embodiments, the filler material may comprise at least about 30 volume percent or at least about 40 volume percent of ternary carbide material. In one embodiment, the filler material may comprise only ternary carbide material and one or more other inter-metallic compounds, such that no free or unbound M is present in the filler material. In some embodiments, the filler material may further comprise free or unreacted catalyst material or further carbide formed with Cr, V, Nb, Ta and/or Ti, or both the free or unreacted catalyst material and the further carbide. In one embodiment, the filler material may comprise at least about 40 volume percent or at least about 50 volume percent tin-based inter-metallic or ternary carbide.

In some embodiments of the invention, the PCD material may have an oxidation onset temperature of at least about 800 degrees centigrade, at least about 900 degrees centigrade or at least about 950 degree centigrade.

Although each of the foregoing PCD material characteristics have been described independently, it should be recognized that the PCD material of the present invention comprises each of the permutations of the aforementioned PCD material characteristics. For example, in one embodiment the body comprises diamond grains having a mean diamond grain contiguity of at least about 60 percent with a standard deviation of the diamond grain contiguity being at most about 4 percent contiguity, at most about 3 percent contiguity or at most about 2 percent contiguity; at least about than 60.5 percent contiguity with a standard deviation of the diamond grain contiguity being at most about 4 percent contiguity, at most about 3 percent contiguity or at most about 2 percent contiguity; at least about 61.5 percent contiguity with a standard deviation of the diamond grain contiguity being at most about 4 percent contiguity, at most about 3 percent contiguity or at most about 2 percent contiguity; at least about 65 percent contiguity with a standard deviation of the diamond grain contiguity being at most about 4 percent contiguity, at most about 3 percent contiguity or at most about 2 percent contiguity; no more than about 80 percent contiguity with a standard deviation of the diamond grain contiguity being at most about 4 percent contiguity, at most about 3 percent contiguity or at most about 2 percent contiguity; or no more than about 77 percent contiguity with a standard deviation of the diamond grain contiguity being at most about 4 percent contiguity, at most about 3 percent contiguity or at most about 2 percent contiguity.

Extending this, in some embodiments the body comprises diamond grains having a size distribution characteristic that at least about 50 percent of the grains have an average size of greater than about 5 microns, and a mean diamond grain contiguity of at least about 60 percent with a standard deviation of the diamond grain contiguity being at most about 4 percent contiguity, at most about 3 percent contiguity or at most about 2 percent contiguity and. By way of further example, in certain embodiments the body comprises diamond grains having a size distribution characteristic that at least about 50 percent of the grains have an average size of greater than about 5 microns, and a mean diamond grain contiguity of at least about 60.5 percent, at least about 61.5 percent, at least about 65 percent, no more than about 80 percent or no more than about 77 percent, with a standard deviation of the diamond grain contiguity about each being at most about 4 percent contiguity, at most about 3 percent contiguity or at most about 2 percent contiguity.

Extending this further, in some embodiments at least about 15 percent or at least about 20 percent of the grains have an average size in the range from about 10 microns to about 15 microns and a mean diamond grain contiguity of at least about 60 percent with a standard deviation of the diamond grain contiguity being at most about 4 percent contiguity, at most about 3 percent contiguity or at most about 2 percent contiguity. By way of further example, in certain embodiments the body comprises diamond grains having a size distribution characteristic that at least about 15 percent or at least about 20 percent of the grains have an average size in the range from about 10 microns to about 15 microns, and a mean diamond grain contiguity of at least about 60.5 percent, at least about 61.5 percent, at least about 65 percent, no more than about 80 percent or no more than about 77 percent, with a standard deviation of the diamond grain contiguity about each being at most about 4 percent contiguity, at most about 3 percent contiguity or at most about 2 percent contiguity.

Extending this still further, in some embodiments the diamond grains may have an average size greater than 0.5 microns, greater than 1 micron, and at most about 60 microns, at most about 30 microns, at most about 20 microns, at most about 15 microns or at most about 7 microns and a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity. In some embodiments of the invention, the PCD material may comprise diamond grains having a mean size of at most about 15 microns, less than about 10 microns or at most about 8 microns and a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity. In some embodiments of the invention, the diamond grains may have an average size in the range from about 0.5 microns to about 20 microns, in the range from about 0.5 microns to about 10 microns, or in the range from about 1 micron to about 7 microns and a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity.

Extending this still further, in some embodiments the content of the diamond in the PCD material may be at least about 88 volume percent, at least about 90 volume percent or at least about 91 volume percent of the PCD material and the PCD material has a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity. In one embodiment, the content of the diamond may be at most about 99 volume percent of the PCD material and the PCD material has a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity. In some embodiments of the invention, the diamond content of the PCD material may be in the range from about 88 volume percent to about 99 volume percent, or in the range from about 90 volume percent to about 96 volume percent of the PCD material and the PCD material has a mean diamond grain contiguity of at least about 60 percent, at least about 60.5 percent, at least about 61.5 percent, at least about 65 percent, no more than about 80 percent or no more than about 77 with a standard deviation of the diamond grain contiguity being at most about 4 percent contiguity, at most about 3 percent contiguity or at most about 2 percent contiguity.

In one embodiment of the invention, the method may include introducing an additive material into the aggregated mass, the additive material containing at least one element selected from V, Ti, Mo, Zr, W, Ta, Hf, Si, Sn or Al. In some embodiments, the additive material may comprise a compound or particles containing at least one element selected from V, Ti, Mo, Zr, W, Ta, Hf, Si, Sn or Al.

In one embodiment of the invention, the method may include introducing into pores or interstices within the aggregated mass a metal other than the catalyst material for diamond. In one embodiment, the metal may not be a catalyst for diamond. In one embodiment, the catalyst material may comprise Co and the metal may be Sn.

In one embodiment of the method, the catalyst material may be a metallic catalyst material. In some embodiments of the invention, the catalyst material may comprise Co, Fe, Ni, and Mn, or alloys including any of these.

In some embodiments of the method, the PCD material may be sintered for a period in the range from about 1 minute to about 30 minutes, in the range from about 2 minutes to about 15 minutes, or in the range from about 2 minutes to about 10 minutes.

In some embodiments of the method, the temperature may be in the range from about 1,400 degrees centigrade to about 2,300 degrees centigrade, in the range from about 1,400 degrees centigrade to about 2,000 degrees centigrade, in the range from about 1,450 degrees centigrade to about 1,700 degrees centigrade, or in the range from about 1,450 degrees centigrade to about 1,650 degrees centigrade.

In some embodiments of the invention, the method may include subjecting the PCD material to a heat treatment at a temperature of at least about 500 degrees centigrade, at least about 600 degrees centigrade or at least about 650 degrees centigrade for at least about 30 minutes. In some embodiments, the temperature may be at most about 850 degrees centigrade, at most about 800 degrees centigrade or at most about 750 degrees centigrade. In some embodiments, the PCD body may be subjected to the heat treatment for at most about 120 minutes or at most about 60 minutes. In one embodiment, the PCD body may be subjected to the heat treatment in a vacuum.

In one embodiment of the invention, the PCD structure may have a region adjacent a surface comprising at most about 2 volume percent of catalyst material for diamond, and a region remote from the surface comprising greater than about 2 volume percent of catalyst material for diamond. In some embodiments, the region adjacent the surface may extend to a depth of at least about 20 microns, at least about 80 microns, at least about 100 microns or even at least about 400 microns from the surface. In one embodiment, at least a portion of the region adjacent the surface may be in the general form of a layer or stratum.

Embodiments of the method of the invention include subjecting the PCD material to a further pressure treatment at a pressure of at least about 2 GPa, at least about 5 GPa or even at least about 6 GPa. In some embodiments, the further pressure treatment may be applied for a period of at least about 10 seconds or at least about 30 seconds. In one embodiment, the further pressure treatment may be applied for a period of at most about 20 minutes.

In one embodiment of the invention, the method may include removing metallic catalyst material for diamond from interstices between the diamond grains of the PCD material.

In one embodiment, an insert comprises an embodiment of PCD material according to the invention, the material bonded to a cemented carbide substrate and the insert being for a drill bit for boring into the earth.

In one embodiment of the invention, the tool component may comprise an embodiment of a PCD structure bonded to a cemented carbide substrate at an interface. In one embodiment, the PCD structure may be integrally formed with the cemented carbide substrate. In one embodiment, the interface may be substantially planar. In one embodiment, the interface may be substantially non-planar.

Figure 2:
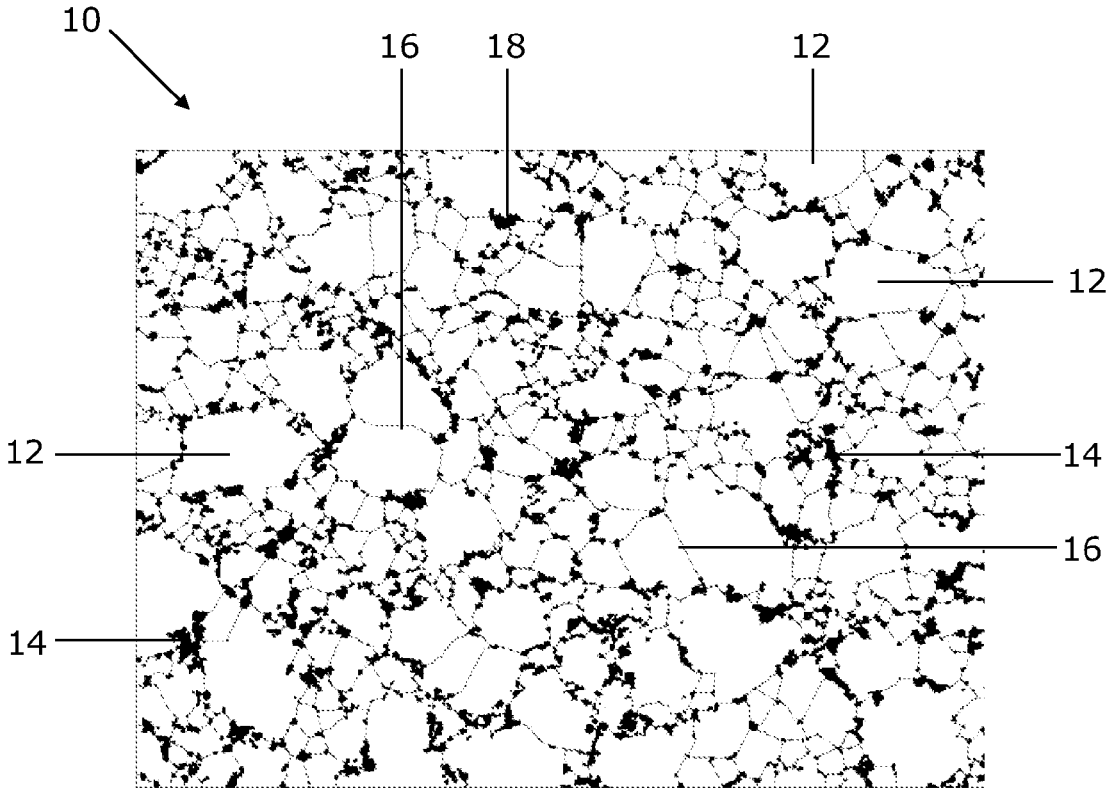
FIG. 2 shows a processed image of a micrograph of a polished section of an embodiment of PCD material.

With reference to FIG. 1 and FIG. 2, an embodiment of PCD material 10 comprises diamond grains 12 having a mean diamond grain contiguity of greater than 60.5 percent. The diamond grains 12 form a skeletal mass defining interstices or interstitial regions 14 between them. The combined lengths of lines passing through all points lying on all bond or contact interfaces 16 between diamond grains within a section of the PCD material are summed to determine the diamond perimeter, and the combined lengths of lines passing through all points lying on all interfaces 18 between diamond and interstitial regions within a section of the PCD material are summed to determine the binder perimeter.

As used herein, "diamond grain contiguity" $\kappa$ is calculated according to the following formula using data obtained from image analysis of a polished section of PCD material:

$\kappa=100*[2*(\delta-\beta)]/[(2*(\delta-\beta))+\delta]$, where $\delta$ is the diamond perimeter, and $\beta$ is the binder perimeter.

As used herein, the diamond perimeter is the fraction of diamond grain surface that is in contact with other diamond grains. It is measured for a given volume as the total diamond-to-diamond contact area divided by the total diamond grain surface area. The binder perimeter is the fraction of diamond grain surface that is not in contact with other diamond grains. In practice, measurement of contiguity is carried out by means of image analysis of a polished section surface. The combined lengths of lines passing through all points lying on all diamond-to-diamond interfaces within the analysed section are summed to determine the diamond perimeter, and analogously for the binder perimeter.

Images used for the image analysis should be obtained by means of scanning electron micrographs (SEM) taken using a backscattered electron signal. Optical micrographs may not have sufficient depth of focus and may give substantially different contrast. The method of measuring diamond grain contiguity requires that distinct diamond grains in contact with or bonded to each other can be distinguished from single diamond grains. Adequate contrast between the diamond grains and the boundary regions between them may be important for the measurement of contiguity since boundaries between grains may be identified on the basis of grey scale contrast. Boundary regions between diamond grains may contain included material, such as catalyst material, which may assist in identifying the boundaries between grains.

FIG. 2 shows an example of a processed SEM image of a polished section of a PCD material 10, showing the boundaries 16 between diamond grains 12. These boundary lines 16 were provided by the image analysis software and were used to measure the diamond perimeter and subsequently for calculating the diamond grain contiguity. The non-diamond regions 14 are indicated as dark areas and the binder perimeter was obtained from the cumulative length of the boundaries 18 between the diamond 12 and the non-diamond or interstitial regions 14.

Figure 3:
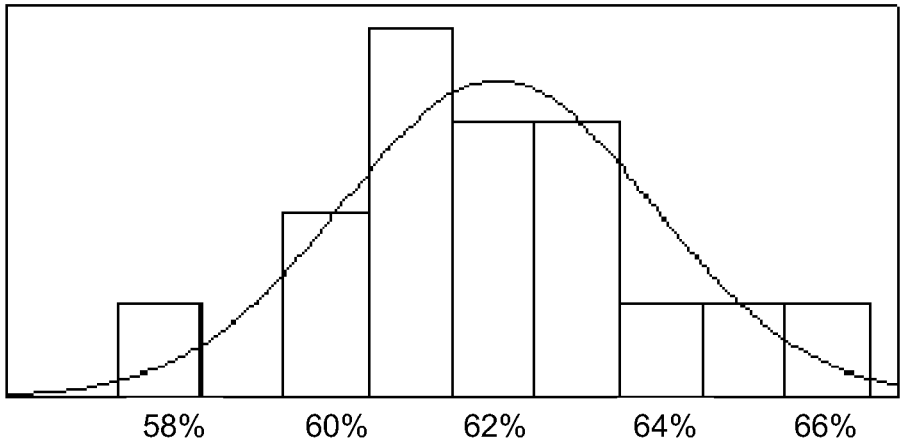
FIG. 3 shows the frequency distribution of diamond grain contiguity of an embodiment of PCD material, with a fitted normal curve superimposed on the distribution.

With reference to FIG. 3, the measured mean diamond grain contiguity of the embodiment of PCD material, the processed image of which is shown in FIG. 2, is about 62 percent. The measured data are shown fitted with a normal or Gaussian curve, from which the standard deviation of the diamond grain contiguity may be determined.

As used herein, the "interstitial mean free path" within a polycrystalline material comprising an internal structure including interstices or interstitial regions, such as PCD, is understood to mean the average distance across each interstitial between different points at the interstitial periphery. The average mean free path is determined by averaging the lengths of many lines drawn on a micrograph of a polished sample cross section. The mean free path standard deviation is the standard deviation of these values. The diamond mean free path is defined and measured analogously.

The homogeneity or uniformity of a PCD structure may be quantified by conducting a statistical evaluation using a large number of micrographs of polished sections. The distribution of the filler phase, which is easily distinguishable from that of the diamond phase using electron microscopy, can then be measured in a method similar to that disclosed in EP 0 974 566 (see also WO2007/110770). This method allows a statistical evaluation of the average thicknesses of the binder phase along several arbitrarily drawn lines through the microstructure. This binder thickness measurement is also referred to as the "mean free path" by those skilled in the art. For two materials of similar overall composition or binder content and average diamond grain size, the material that has the smaller average thickness will tend to be more homogenous, as this implies a finer scale distribution of the binder in the diamond phase. In addition, the smaller the standard deviation of this measurement, the more homogenous is the structure. A large standard deviation implies that the binder thickness varies widely over the microstructure, i.e. that the structure is not even, but contains widely dissimilar structure types.

Figure 4:
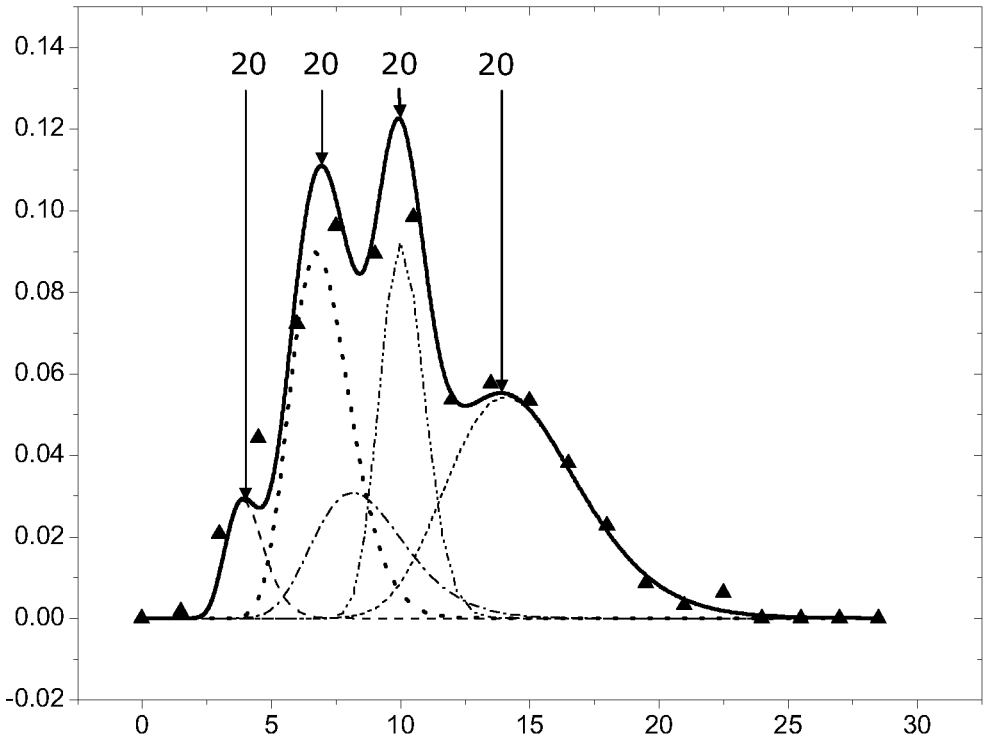
FIG. 4 shows a number frequency graph of equivalent circle diameter (ECD) grain size, shown on the horizontal axis, for an embodiment of PCD material.
Figure 5:
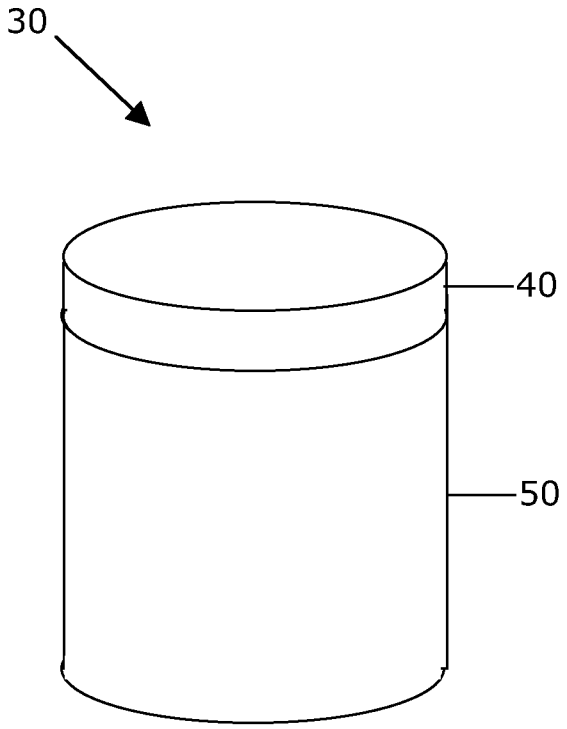
FIG. 5 shows a schematic drawing of an embodiment of an insert a rotary drill bit for boring into the earth.

With reference to FIG. 4, which shows one non-limiting example of a multi-modal grain size distribution for the purpose of illustration, a multimodal size distribution of a mass of grains is understood to mean that the grains have a size distribution with more than one peak 20, each peak 20 corresponding to a respective "mode". Multimodal polycrystalline bodies are typically made by providing more than one source of a plurality of grains, each source comprising grains having a substantially different average size, and blending together the grains or grains from the sources. Measurement of the size distribution of the blended grains may reveal distinct peaks corresponding to distinct modes. When the grains are sintered together to form the polycrystalline body, their size distribution is further altered as the grains are compacted against one another and fractured, resulting in the overall decrease in the sizes of the grains. Nevertheless, the multimodality of the grains may still be clearly evident from image analysis of the sintered article.

Unless otherwise stated herein, dimensions of size, distance, perimeter, ECD, mean free path and so forth relating to grains and interstices within PCD material, as well as the grain contiguity, refer to the dimensions as measured on a surface of, or a section through a body comprising PCD material and no stereographic correction has been applied. For example, the size distributions of the diamond grains as shown in FIG. 4 were measured by means of image analysis carried out on a polished surface, and a Saltykov correction was not applied.

In measuring the mean value and deviation of a quantity such as grain contiguity, or other statistical parameter measured by means of image analysis, several images of different parts of a surface or section are used to enhance the reliability and accuracy of the statistics. The number of images used to measure a given quantity or parameter may be at least about 9 or even up to about 36. The number of images used may be about 16. The resolution of the images needs to be sufficiently high for the inter-grain and inter-phase boundaries to be clearly made out. In the statistical analysis, typically 16 images are taken of different areas on a surface of a body comprising the PCD material, and statistical analyses are carried out on each image as well as across the images. Each image should contain at least about 30 diamond grains, although more grains may permit more reliable and accurate statistical image analysis.

Catalyst material may be introduced to an aggregated mass of diamond grains for sintering in any of the ways known in the art. One way includes depositing metal oxide onto the surfaces of a plurality of diamond grains by means of precipitation from an aqueous solution prior to forming their consolidation into an aggregated mass. Such methods are disclosed in PCT publications numbers WO2006/032984 and also WO2007/110770. Another way includes preparing or providing metal alloy including a catalyst material for diamond, such as cobalt-tin alloy, in powder form and blending the powder with the plurality of diamond grains prior to their consolidation into an aggregated mass. The blending may be carried out by means of a ball mill. Other additives may be blended into the aggregated mass.

In one embodiment, the aggregated mass of diamond grains, including any catalyst material particles or additive material particles that may have been introduced, may be formed into an unbonded or loosely bonded structure, which may be placed onto a cemented carbide substrate. The cemented carbide substrate may contain a source of catalyst material for diamond, such as cobalt. The assembly of aggregated mass and substrate may be encapsulated in a capsule suitable for an ultra-high pressure furnace apparatus capable of subjecting the capsule to greater than 6 GPa. Various kinds of ultra-high pressure apparatus are known and can be used, including belt, torroidal, cubic and tetragonal multi-anvil systems. The temperature of the capsule should be high enough for the source of catalyst material to melt and low enough to avoid substantial conversion of diamond to graphite. The time should be long enough for sintering to be completed but as short as possible to maximise productivity and reduce costs.

PCT publication number WO2009/027948 describes polycrystalline diamond material comprising a diamond phase and a filler material, the filler material comprising ternary carbide, and PCT publication number WO2009/027949 describes polycrystalline diamond material comprising intergrown diamond grains and a filler material comprising a tin-based inter-metallic or ternary carbide compound formed with a metallic catalyst.

EXAMPLES

Embodiments of the invention are described in more detail with reference to the examples below, which are not intended to limit the invention.

Example 1

An aggregated mass of diamond grains having a mean size of about 8 microns was formed by blending diamond powder from two sources having respective mean grain sizes in the range from about 1 micron to about 4 microns and in the range from about 7 microns to about 15 microns. The blended diamond grains were treated in acid to remove surface impurities that may have been present. Vanadium carbide (VC) powder and cobalt (Co) powder were introduced into the diamond powder by blending particles of VC and Co with the diamond powder using a planetary ball mill. The mean size of the VC particles was about 4 microns and the content of the VC in the aggregated mass was about 3 weight percent. The aggregated mass was then formed into a layer on a substrate comprising Co-cemented tungsten carbide (WC) and encapsulated within a capsule for an ultra-high pressure furnace to form a pre-sinter assembly, which was then out-gassed in a vacuum to remove surface impurities from the diamond grains, as is known in the art. The diameter of the substrate was a little greater than about 13 mm and the height was about 10 mm.

The pre-sinter assembly was subjected to a pressure of about 6.8 GPa and a temperature of about 1,600 degrees centigrade in an ultra-high pressure furnace to sinter the diamond grains and form a PCD compact comprising a layer of PCD material integrally formed with the carbide substrate. The PCD layer was about 2 mm thick. During the sintering process, molten cobalt from the substrate and containing dissolved W or WC, or both in solution infiltrated into the aggregate mass of diamond grains.

A section was cut from the PCD material and a section surface was polished. Sixteen digital images of microscopic areas were obtained at different respective positions on the section surface by means of scanning electron micrography (SEM) using a backscattered electron signal. The resolution of the images was 0.04717 micrometers per pixel. Each of the images was subjected to image analysis to measure the mean diamond grain contiguity, the mean diamond grain ECD, the mean interstitial ECD, the diamond grain mean free path and the interstitial mean free path, as well as the standard deviations of each of these quantities. These quantities were then averaged over those obtained for all the images. In the case of the diamond grain and interstitial ECD size measurement, the size distribution was characterised more fully, as described below. In performing the image analysis, the contrast between the diamond grains and the boundary regions between diamond grains was adjusted to emphasise boundaries between grains on the basis of grey scale contrast.

The image analysis was performed using software having the trade name analySIS Pro from Soft Imaging System® GmbH (a trademark of Olympus Soft Imaging Solutions GmbH) may be used. This software has a "Separate Grains" filter, which according to the operating manual provides satisfactory results if the structures to be separated are closed structures. Therefore, it is important to fill up any holes before applying this filter. The "Morph. Close" command, for example, may be used or help may be obtained from the "Fillhole" module. In addition to this filter, the "Separator" is another powerful filter available for grain separation. This separator can also be applied to color- and gray-value images, according to the operating manual.

Results of the image analysis are summarised in Tables 1 and 2. The content of diamond was measured to be about 90.8 volume percent, the diamond grain contiguity was about 68.4 percent and the mean size of the sintered diamond grains was about 6.3 microns in terms of equivalent circle diameter. The average interstitial mean free path of the PCD material was about 0.52 (±0.46) micron.

The data relate to two dimensional measurements taken from image analysis of a scanning electron micrograph, and has not been corrected for three dimensions. For example, the quoted mean diamond grain size is the mean size corresponding to the cross-sectional areas of diamond grains. The diamond and interstitial sizes are calculated as equivalent circle diameters (ECD), by determining the cross-sectional area and calculating the diameter of a circle having the area. The statistical parameters d10, d50, d75 and d90 refer to the sizes (ECD) for which 10 percent, 50 percent, 75 percent and 90 percent, respectively, of grains are less than. The maximum size is the size for which substantially no grains are greater. The parameters "Lower (95 percent)" and "Upper (95 percent)" refer to the size values for which 5 percent of grains are less than and greater than, respectively.

TABLE 1

| | Mean, microns | Standard deviation, microns | d10, microns | d50, microns | d75, microns | d90, microns | Maximum, micron |
|---|---|---|---|---|---|---|---|
| Diamond grain size | 6.30 | 2.52 | 2.77 | 6.17 | 8.06 | 9.10 | 12.40 |
| Interstitial size | 1.75 | 0.90 | 0.63 | 1.63 | 2.26 | 2.94 | 3.98 |
| Diamond grain MFP* | 4.51 | 4.96 | 0.33 | 2.74 | 6.65 | 11.04 | 49.25 |
| Interstitial MFP* | 0.52 | 0.46 | 0.09 | 0.38 | 0.71 | 1.13 | 4.72 |

*MFP is mean free path

TABLE 2

| | Mean, percent | Standard deviation | Lower (95 percent) | Upper (95 percent) |
|---|---|---|---|---|
| Diamond content, percent area | 90.7 | 0.56 | 90.4 | 91.0 |
| Interstitial, percent area | 9.25 | 0.56 | 8.95 | 9.55 |
| Diamond contiguity, percent | 68.0 | 1.15 | 67.4 | 68.6 |

An aggregated mass of diamond grains having a mean size of about 10 microns was formed by blending diamond powder from five sources having respective mean grain size in the range from about 0.5 micron to about 3 microns, in the range from about 2 microns to about 5 microns, in the range from about 4 microns to about 9 microns, in the range from about 7 microns to about 15 microns and in the range from about 10 microns to about 30 microns. The blended diamond grains were treated in acid to remove surface impurities that may have been present. Vanadium carbide (VC) powder and cobalt (Co) powder were introduced into the diamond powder by blending particles of VC and Co with the diamond powder using a planetary ball mill. The mean size of the VC particles was about 4 microns and the content of the VC in the aggregated mass was about 3 weight percent. The aggregated mass was then formed into a layer on a substrate comprising Co-cemented tungsten carbide (WC) and encapsulated within a capsule for ultra-high pressure furnace to form a pre-sinter assembly, which was then out-gassed in a vacuum to remove surface impurities from the diamond grains, as is known in the art. The diameter of the substrate was a little greater than about 13 mm and the height was about 2 mm.

The pre-sinter assembly was subjected to a pressure of about 8 GPa and a temperature of about 1,700 degrees centigrade in an ultra-high pressure furnace to sinter the diamond grains and form a PCD compact comprising a layer of PCD material integrally formed with the carbide substrate. The PCD layer was about 2 mm thick. During the sintering process, molten cobalt from the substrate and containing dissolved W or WC, or both, in solution infiltrated into the aggregate mass of diamond grains.

SEM images of the PCD material were obtained as described in Example 1, except that the resolution of the images was 0.09434 micrometers per pixel. Results of image analysis of the images are shown in Table 3 and Table 4 below. The content of diamond was about 90.7 volume percent, the diamond grain contiguity was about 70.3 percent and the mean size of the sintered diamond grains was about 7.4 microns in terms of equivalent circle diameter.

TABLE 3

| | Mean, microns | Standard deviation, microns | d10, microns | d50, microns | d75, microns | d90, microns | Maximum, micron |
|---|---|---|---|---|---|---|---|
| Diamond grain size | 7.4 | 3.4 | 2.8 | 6.9 | 9.9 | 12.0 | 14.2 |
| Interstitial size | 2.95 | 1.41 | 1.0 | 2.9 | 3.9 | 4.8 | 5.9 |
| Diamond grain MFP* | 5.0 | 6.1 | 0.23 | 2.7 | 7.2 | 13.0 | 58.9 |
| Interstitial MFP* | 0.66 | 0.68 | 0.09 | 0.42 | 0.89 | 1.5 | 7.04 |

*MFP is mean free path

TABLE 4

| | Mean, percent | Standard deviation | Lower (95 percent) | Upper (95 percent) |
|---|---|---|---|---|
| Diamond content, percent area | 90.7 | 0.56 | 90.4 | 91.0 |
| Interstitial, percent area | 9.2 | 0.56 | 8.9 | 9.55 |
| Diamond contiguity, percent | 70.3 | 1.9 | 69.2 | 71.3 |

The PCD compact was processed to form a test PCD cutter insert, which was subjected to a wear test. The wear test involved using the insert in a vertical turret milling apparatus to cut a length of a workpiece material comprising granite until the insert failed by fracture or excessive wear. The distance cut through the workpiece before the insert was deemed to have failed may be an indication of expected working life in use. The cutting distance achieved with the test insert was about 75 percent greater than that achieved using a control PCD cutter insert, which had been sintered at a pressure of about 5.5 GPa and which contained no VC additive. The abrasion resistance of the test cutter insert was observed to be substantially enhanced.

Example 3

Test and control PCD material samples were prepared using sintering pressures of 6.8 GPa and 5.5 GPa, respectively. In all other respects the test and control samples were made in the same way. Raw material diamond powder was prepared by blending diamond grains from three sources, each source having a different average grain size distribution. The size distribution of the grains within the resulting blended powder had the size distribution characteristic that 9.8 weight percent of the grains had average grain size less than 5 microns, 7.6 weight percent of the grains had average size in the range from 5 microns to 10 microns, and 82.6 weight percent of the grains had average grain size greater than 10 microns. The blended diamond grains had an average size of approximately 20 micron.

Cobalt and tin were deposited onto the surfaces of the diamond grains by means of a method including depositing cobalt and tin oxides onto the surfaces from an aqueous solution. The cobalt-tin accounted for about 7.5 percent of the coated diamond mass, and was found to be dispersed over the grain surfaces as nano-scale formations.

The cobalt-tin coated diamond grains were formed into an aggregated mass on a surface of a cobalt-cemented tungsten carbide substrate, and this assembly was encapsulated within a refractory metal jacket to form a pre-compact assembly, from which air was subsequently removed. The pre-compact assembly was loaded into a capsule for a high-pressure high temperature furnace.

The test material was subjected to a pressure of about 6.8 GPa and a temperature of 1,550 degrees centigrade for about 9 minutes to form a compact comprising a sintered PCD mass bonded to a tungsten carbide substrate.

The control material was subjected to a conventionally used pressure of about 5.5 GPa and a temperature of about 1,450 degrees centigrade for about 9 minutes to form a compact comprising a sintered PCD mass bonded to a tungsten carbide substrate.

The compacts were substantially cylindrical in shape, having a diameter of about 16 mm. The compacts comprised a layer of PCD integrally bonded onto a cobalt-cemented tungsten carbide (WC) substrate, the PCD layers being 2.2 mm thick. The diamond content of the PCD layer was about 92 percent by volume, the balance being cobalt and minor precipitated phases such as WC. The diamond grains within the PCD thus produced had a multimodal size distribution having the characteristic that 34.7 weight percent of the grains had average grain size less than 5 microns, 40.4 weight percent of the grains had average size in the range from 5 microns to 10 microns, and 24.9 weight percent of the grains had average grain size greater than 10 microns. The grain size distribution of the sintered PCD is different from that of the input grains due to mutual crushing of the grains at high pressure, in addition to the shift towards coarser grain sizes that normally occurs during the sintering process.

The control and test compacts were analysed. Both were found to comprise PCD with the following phases present in the interstices: $Co_3Sn_2$, $Co_3SnC_{0.7}$, CoSn, Co and WC. The major phase was $Co_3SnC_{0.7}$, and it is believed that this phase plays a major role in improving the thermal stability of the PCD. The other phases were present in trace quantities.

Image analysis was used to analyse the inter-growth of the diamond grains as well as the homogeneity of their spatial distribution within the PCD. A higher degree of diamond grain inter-growth was observed within the PCD of the test compact as compared to that within the control compact. The grain intergrowth and contact can be expressed in terms of diamond grain contiguity, the average contiguity of the test PCD being 62.0 percent (±1.9 percent), compared to the control PCD average contiguity of being 59.2 percent (±1.4 percent), the figure in brackets being the standard deviation). Statistically, this absolute difference of 2.8 percent may be substantial, since an absolute difference in contiguity of 0.8 percent corresponds to a confidence interval of 95 percent.

The average interstitial mean free path of the test PCD was about 0.74 (±0.62) micron, compared to the control PCD average of 1.50 (±2.53) micrometers.

More cobalt was present in the test PCD than in the control PCD, the additional cobalt having infiltrated from the cobalt-containing substrate, it is believed. This resulted in the test PCD having a higher content of $Co_3SnC_{0.7}$ than the control PCD. Additionally, the content of WC was higher in the test PCD, which contained a greater quantity of re-crystallised WC "plume" formations near the interface with the substrate.

Results of image analysis of the test material are summarised in Tables 5 and 6. The data relate to two dimensional measurements taken from image analysis of a scanning electron micrograph, and has not been corrected for three dimensions. The parameters in the table have the same meaning as described in Example 1.

TABLE 5

| | Mean, microns | Standard deviation, microns | d10, microns | d50, microns | d75, microns | d90, microns | Maximum, micron |
|---|---|---|---|---|---|---|---|
| Diamond grain size | 9.42 | 4.33 | 3.43 | 9.10 | 13.09 | 15.04 | 19.23 |
| Interstitial size | 2.19 | 1.08 | 0.80 | 2.01 | 3.42 | 3.5 | 5.48 |
| Diamond grain MFP* | 5.94 | 7.09 | 0.38 | 3.11 | 8.3 | 15.47 | 67.92 |
| Interstitial MFP* | 0.68 | 0.60 | 0.19 | 0.47 | 0.94 | 1.42 | 6.51 |

*MFP is mean free path

TABLE 6

| | Mean, percent | Standard deviation | Lower (95 percent) | Upper (95 percent) |
|---|---|---|---|---|
| Diamond content, percent area | 90.54 | 0.57 | 90.24 | 90.84 |
| Interstitial, percent area | 9.46 | 0.57 | 9.16 | 9.76 |
| Diamond contiguity, percent | 62.05 | 1.86 | 61.06 | 63.04 |

Both the control and test samples were processed to form inserts suitable for rock boring, and subjecting the inserts to a wear test that involved using the inserts to machine a granite block mounted on a vertical turret milling apparatus. This test involved machining a granite block over a number of passes and measuring the size of the wear scar formed into the PCD as a result of abrasive wear against the granite. After 50 passes, wear scar of the test PCD was about 30 percent smaller than that of the control PCD, and lasted at least another 100 passes in working condition.

When several more samples of test and control PCD were manufactured, it was found that the quality of the test PCD was much more consistent than that of the control PCD, and the reject rate was much lower.

It has been found that the use of a method according to the first aspect of the invention permits thick PCD structures to be sintered. Thicker PCD structures have greater strength, all else being equal, than thinner PCD structures.

Example 4

Several samples of Co—Sn-based PCD sintered onto a cemented carbide substrate were prepared. In each case, tin powder was pre-reacted with cobalt metal powder to produce a CoSn alloy/intermetallic of specific atomic ratio 1:1. This pre-reacted source was then introduced into an unsintered diamond powder mass by either pre-synthesis admixing or in situ infiltration. The 1:1 CoSn pre-reacted powder mixture was prepared by milling the Co and Sn powders together in a planetary ball mill. The powder mixture was then heat-treated in a vacuum furnace (600 degrees centigrade to 800 degrees centigrade) to manufacture reacted CoSn material. This pre-reacted material was then further crushed/milled to break down agglomerates and reduce the grain size. The diamond powder size distribution had an average grain size of less than about 10 microns. A chosen amount of this CoSn material (expressed as a weight percent of the diamond powder mass) was then brought into contact with the unsintered diamond powder within an ultra-high pressure furnace reaction volume. This was either as a discrete powder layer adjacent to the diamond powder mass (which would infiltrate the diamond during ultra-high pressure treatment after melting, i.e. in situ infiltration) or the CoSn material was admixed directly into the diamond powder mixture before the canister was loaded. The diamond powder/CoSn assembly was then placed adjacent a cemented carbide substrate such that the binder metallurgy was then further augmented by the infiltration of additional cobalt from the cemented carbide substrate at the ultra-high pressure conditions. The assembly was subjected to a pressure of about 6.8 GPa and a temperature above the melting point of cobalt. In this way, a range of Co:Sn ratio binder systems and resultant PCD materials was produced.

Example 5

A mono-modal PCD test material was prepared by blending cobalt powder with diamond grains by means of a planetary ball mill, and sintering the blended mixture at a pressure of 7.7 GPa and a temperature of about 2,100 degrees centigrade for a period of about 60 seconds. The diamond grains had average size in the range from 3 micron to 6 micron. The weight ratio of cobalt to diamond in the blended powder mix was 18:82. Free-standing, unsupported sintered PCD samples having diameter of 13.7 mm and height of 4 mm were produced.

A control PCD material was made similarly to the test material, except that i) the cobalt was introduced by infiltration from a cemented tungsten carbide substrate, as is conventional, resulting in a weight ratio of cobalt to diamond was 26:74, and ii) a sintering pressure of 5.5 GPa and temperature of about 1,450 degrees centigrade was used.

A scanning electron micrograph of a polished section of the sintered test PCD was obtained using backscattered electrons, and image analysis was carried out on the micrograph. Results of image analysis of the test material are summarised in Tables 7 and 8, the parameters having the same meaning as defined in Example 1.

TABLE 7

| | Mean, microns | Standard deviation, microns | d10, microns | d50, microns | d75, microns | d90, microns | Maximum, micron |
|---|---|---|---|---|---|---|---|
| Diamond grain size | 4.73 | 2.22 | 1.87 | 4.86 | 7.12 | 7.33 | 9.09 |
| Interstitial size | 1.11 | 0.58 | 0.41 | 0.98 | 1.49 | 1.68 | 3.14 |
| Diamond grain MFP* | 3.63 | 3.30 | 0.47 | 2.74 | 4.74 | 8.23 | 46.18 |
| Interstitial MFP* | 0.32 | 0.31 | 0.05 | 0.23 | 0.47 | 0.74 | 3.40 |

*MFP is mean free path

TABLE 8

| | Mean, percent | Standard deviation | Lower (95 percent) | Upper (95 percent) |
|---|---|---|---|---|
| Diamond content, percent area | 91.24 | 0.35 | 91.05 | 91.43 |
| Interstitial, percent area | 8.76 | 0.35 | 8.57 | 8.95 |
| Diamond contiguity, percent | 73.54 | 0.67 | 73.19 | 73.90 |

The test and control samples were formed into cutting inserts by conventional processing and subjected to a wear test involving the milling of granite. A depth of cut of 1 mm depth was used. The output of the wear test is a cutting length, which is the distance of granite milled before the cutter is deemed to have failed. The cutting length of the test PCD was about 5,100 mm, which is significantly greater than the control PCD cutting length of about 1,200 mm. This indicates that the abrasive wear resistance of the test PCD is several times greater than that of the control PCD.

Embodiments of the invention may have the advantage of enhanced abrasion resistance, and embodiments of the invention have enhanced strength and enhanced thermal stability. Any or all of these advantages may result from the enhanced diamond contiguity of the PCD material. If the mean diamond grain contiguity is substantially less than about 60 percent, enhanced abrasion resistance, enhanced strength or thermal stability, or a combination of these properties, may not be exhibited. In some embodiments of the invention, enhanced diamond grain contiguity may arise from the use of diamond grains having a multimodal size distribution in which the grain size distribution characteristics are selected according to an embodiment of the invention. If the standard deviation of the diamond grain contiguity is substantially greater than about 4 percent contiguity, then the advantages arising from having high mean grain contiguity may be substantially reduced. If the diamond grain contiguity is substantially greater than about 80 percent or even substantially greater than about 77 percent, then the fracture resistance of the PCD material may be too low. If the volume of the PCD material is substantially less than about 0.5 $mm^2$, then it may be too small for practical use in certain cutting or drilling operations.

Enhanced contiguity and inter-grain bonding may result in increased strength, abrasion resistance and thermal stability. While wishing not to be bound by theory, increased thermal stability or resistance may be due to reduced interfacial area between catalyst material and diamond within the microstructure.

Embodiments of PCD material according to the invention may exhibit enhanced diamond contiguity and enhanced inter-grain bonding, more homogeneous spatial distribution of the diamond grains, less porosity and lower overall catalyst content, all of which may generally be regarded as beneficial. Improved homogeneity may result in less variability in the performance of the PCD in use.

In some embodiments of the invention, the combination of high contiguity and/or high homogeneity and/or reduced content of metallic catalyst within the PCD on the one hand, and a size distribution comprising at least two peaks or modes, or at least three peaks or modes, on the other may result in substantial improvement in wear resistance and other properties of the PCD, and consequently enhanced working life and cutting or penetration rate of the polycrystalline diamond element in rock drilling or earth boring applications, and shear cutting rock drilling in particular. This combination of features may be synergistic.

Metallic catalyst materials for diamond may result in excellent inter-grain diamond bonding and sintering, and consequently in PCD material having high abrasion resistance and strength. However, residual metallic catalyst material may remain within the sintered PCD, located within interstices between the diamond grains, and may reduce the thermal stability of the PCD material. "Thermal stability" refers to the relative insensitivity of key mechanical properties of PCD material, such as abrasion resistance and strength, as a function of temperature, particularly to temperatures up to about 700 degrees centigrade or even up to about 800 degrees centigrade. Sintering PCD material using pressures greater than 6.0 GPa may tend to enhance the thermal stability PCD comprising metallic filler material. Reduced content of catalyst material in the sintered PCD may enhance thermal stability. This may be because catalyst material may promote the re-conversion of diamond to graphite at the elevated temperatures and ambient pressure that typically prevail in use. Such re-conversion may significantly weaken the PCD material. In addition, metallic catalyst material generally has much higher thermal coefficient of expansion than diamond and its presence may increase internal stresses within the PCD as the temperature increases or decreases, which may weaken the material. Metallic catalyst material is may also be vulnerable to oxidation, which may further increases internal stresses.

Embodiments of tools according to the invention may have enhanced performance. In particular, earth boring drilling bits equipped with inserts comprising PCD with enhanced diamond grain contiguity and sintered using a pressure of greater than 6 GPa may exhibit superior performance in oil and gas drilling applications. Similar benefits may also be derived where other catalyst materials are used.

If the pressure used to sinter the PCD material is less than about 6 GPa, the diamond grain contiguity and may not be high enough, and certain mechanical properties such as abrasion resistance, thermal stability and strength may not be substantially enhanced. In embodiments of the method of the invention, it may be desirable for the pressure to be as low as possible, but still greater than 6 GPa, in order to permit larger reaction volumes to be used and consequently larger articles to be sintered. Use of lower pressures may reduce costs and engineering complexity. In some embodiments of the method of the invention where the diamond grains have an average size of 1 micron or less, a sintering pressure of greater than about 7.0 GPa may result in improved sintering of sub-micron diamond grains.

Embodiments of the method of the invention may have the advantage that higher temperatures can be used to form the PCD material by sintering, which may be beneficial for the properties of the material; especially where the filler material and/or catalyst material used has a relatively high melting point.

Embodiments of the method of the invention may be particularly beneficial where the polycrystalline diamond material includes a filler material comprising ternary carbide material, and the thermal stability of the PCD material in particular may be enhanced. This may arise because ternary metal carbide may be relatively inert with respect to diamond. Embodiments of the method of the invention may be particularly beneficial for a type of PCD material that includes a filler material comprising a tin-based inter-metallic or ternary carbide compound formed with a metallic catalyst for diamond. Embodiments of the method of the invention may be particularly beneficial for making PCD material having a filler material comprising cobalt and tin, particularly in which the average diamond grain size is less than about 10 micron, and in which at least some of the filler material is introduced by infiltration. Embodiments of the method of the invention have the advantage of substantially reducing the incidence of defects associated with poor sintering, which tend to occur near the upper surface of a PCD structure. Consequently fewer PCD elements may be rejected, resulting in improved process economics. The PCD material may tend to have enhanced strength, abrasion resistance and thermal stability, including oxidation resistance.

The thermal stability of embodiments of PCD material according to the invention, particularly the oxidation onset temperature as measured by means of thermo-gravimetric analysis (TGA), may be substantially enhanced. Embodiments such as these may be thermally stable and exhibit superior performance in applications such as oil and gas drilling, wherein the temperature of a PCD cutter element can reach above about 700 degrees centigrade. Oxidation onset temperature is measured by means of thermo-gravimetric analysis (TGA) in the presence of oxygen, as is known in the art.

A tool comprising a PCD material according to the invention may be especially advantageous for the cutting or machining of metal, owing to the enhanced thermal stability and resistance of the PCD material.

Although the foregoing description of PCD material, tools, manufacturing methods and various applications contain many specifics, these should not be construed as limiting the scope of the invention, but merely as providing illustrations of some example embodiments. Similarly, other embodiments of the invention may be devised which do not depart from the spirit or scope of the present invention. The scope of the invention is indicated and limited only by the appended claims and their legal equivalents, rather than by the foregoing description. All additions, deletions, and modifications to the invention, as disclosed herein, which fall within the meaning and scope of the claims are to be embraced.

What is claimed is:

1. A polycrystalline diamond (PCD) material comprising a body comprising at least about 88 volume percent and at most about 99 volume percent diamond grains, the mean diamond grain contiguity being greater than about 60 percent, the PCD material including a filler material comprising a ternary carbide of the formula MxM'yCz, M being at least one element selected from the group consisting of the transition metals and the rare earth metals; M' being an element selected from the group consisting of Al, Ga, In, Ge, Sn, Pb, Tl, Mg, Zn and Cd; x being in the range from about 2.5 to about 5.0; y being in the range from about 0.5 to about 3.0; and z being in the range from about 0.1 to about 1.2.

2. The PCD material as claimed in claim 1, the diamond grain contiguity being at most about 80 percent.

3. The PCD material as claimed in claim 1, the standard deviation of the diamond grain contiguity being at most about 4 percent contiguity.

4. The PCD material as claimed in claim 1, the material having a volume of at least about 0.5 $mm^2$.

5. The PCD material as claimed in claim 1, the diamond grains having the size distribution characteristic that at least about 50 weight percent of the grains have an average size of greater than about 5 microns.

6. The PCD material as claimed in claim 1, comprising diamond grains having a multimodal size distribution.

7. The PCD material as claimed in claim 1, comprising diamond grains having a mean size of at most about 15 microns.

8. The PCD material as claimed in claim 1, having an average interstitial mean free path of at most about 1.5 microns.

9. The PCD material as claimed in claim 1, in which the standard deviation of the interstitial mean free path is in the range from about 0.05 microns to about 1.5 micron.

10. The PCD material as claimed in claim 1, having a mean interstitial size of at least about 0.5 micron and at most about 4 microns.

11. The PCD material as claimed in claim 1, in which M is selected from the group consisting of Co, Fe, Ni, Mn, Cr, Pd, Pt, V, Nb, Ta, Ti, Zr, Ce, Y, La and Sc.

12. The PCD material as claimed in claim 1, having an oxidation onset temperature of at least about 800 degrees centigrade.

13. The PCD material as claimed in claim 1, having a region adjacent a surface comprising at most about 2 volume percent of catalyst material for diamond, and a region remote from the surface comprising greater than about 2 volume percent of catalyst material for diamond.

14. An insert comprising the PCD material as claimed in claim 1, the PCD material bonded to a cemented carbide substrate, the insert being for a drill bit for boring into the earth.

15. The polycrystalline diamond (PCD) as claimed in claim 1, the mean diamond grain contiguity being greater than about 60 percent and at most about 80 percent.

16. The PCD material as claimed in claim 15, the mean diamond grain contiguity being at least about 65 percent and at most about 80 percent.

17. The PCD material as claimed in claim 15, the diamond grains having the size distribution characteristic that at least about 50 weight percent of the grains have an average size of greater than about 5 microns.

18. The PCD material as claimed in claim 15, comprising diamond grains having a mean size of at most about 15 microns.

19. The PCD material as claimed in claim 15, having an average interstitial mean free path of at most about 1.5 microns.

20. The PCD material as claimed in claim 15, in which the standard deviation of the interstitial mean free path is in the range from about 0.05 microns to about 1.5 micron.

21. The PCD material as claimed in claim 15, the mean diamond grain contiguity being at least about 65 percent and at most about 80 percent; the diamond grains having the size distribution characteristic that at least about 50 weight percent of the grains have an average size of greater than about 5 microns and the diamond grains have a mean size of at most about 15 microns.

* * * * *